US012104444B2

(12) United States Patent
Buttazzoni Fontaine et al.

(10) Patent No.: US 12,104,444 B2
(45) Date of Patent: Oct. 1, 2024

(54) HANDLING DEVICE FOR DRILLING BARS OR PIPES OF DIFFERENT SIZES

(71) Applicant: SAFEDRILL SPA., Santiago (CL)

(72) Inventors: Tomás Antonio Buttazzoni Fontaine, Santiago (CL); Eduardo Alfonso Vasquez Hauva, Santiago (CL); Nelson Hernando Herrera Roman, Santiago (CL); Luis Rafael Plaza Montero, Santiago (CL); Stefano Giovanni Zunino Bouffanais, Santiago (CL)

(73) Assignee: SAFEDRILL SPA., Quilicura (CL)

( * ) Notice: Subject to any disclaimer, the term of this patent is extended or adjusted under 35 U.S.C. 154(b) by 0 days.

(21) Appl. No.: 18/303,408

(22) Filed: Apr. 19, 2023

(65) Prior Publication Data

US 2023/0392454 A1 Dec. 7, 2023

(30) Foreign Application Priority Data

Jun. 1, 2022 (CL) ..... CL 202201438

(51) Int. Cl.
*E21B 19/087* (2006.01)
*E21B 19/18* (2006.01)
*E21B 19/24* (2006.01)

(52) U.S. Cl.
CPC ..... *E21B 19/087* (2013.01); *E21B 19/18* (2013.01); *E21B 19/24* (2013.01)

(58) Field of Classification Search
CPC ..... E21B 19/16; E21B 19/18; E21B 19/20; E21B 19/155; E21B 19/15; E21B 15/04; E21B 19/087
See application file for complete search history.

(56) References Cited

U.S. PATENT DOCUMENTS 4,482,289 A * 11/1984 Inaba ..... B25J 15/0052 414/751.1
4,591,007 A * 5/1986 Shaginian ..... E21B 19/06 414/22.55
4,604,724 A * 8/1986 Shaginian ..... E21B 19/20 702/9
5,518,575 A * 5/1996 Watanabe ..... B29C 66/7373 156/499
6,634,443 B1 10/2003 Paech
7,036,202 B2 * 5/2006 Lorenz ..... E21B 19/155 269/45
2022/0003050 A1 * 1/2022 Larose ..... E21B 19/08

FOREIGN PATENT DOCUMENTS

CL 0375-2014 2/2014
CL 2516-2020 9/2020
JP 08296388 A * 11/1996 ..... E21B 19/14
WO 2020154804 A1 8/2020

* cited by examiner

*Primary Examiner* — Gregory W Adams
(74) *Attorney, Agent, or Firm* — Merchant & Gould P.C.

(57) ABSTRACT

Handling device associated with a drilling rig to manipulate bars or drilling tubes between a vertical position and a horizontal position in an automated manner that reduces risks in the operation, which is basically made up of a support, a carriage, and an arm with an arm support and at least two gripping means on the arm, separated from each other, for holding, capturing or gripping the drill rods, wherein at least one of said gripping means is movable so that it can be moved or moved to length of the arm, allowing to vary the separation distance between the means of gripping the arm, facilitating the handling of rods or perforation pipes of different lengths.

15 Claims, 9 Drawing Sheets

HANDLING DEVICE FOR DRILLING BARS OR PIPES OF DIFFERENT SIZES

CROSS-REFERENCE TO RELATED APPLICATIONS

This application claims the benefit of Serial No.: CL202201438, filed Jun. 1, 2022 in Chile, and which application is incorporated herein by reference. To the extent appropriate, a claim of priority is made to the above disclosed application.

TECHNICAL FIELD

This invention is related of the mineral drilling, probing and exploration industry, specifically it refers to a handling device that reduces risks and facilitates the handling of a drilling rod or tube of different sizes, which works in an automated way, reducing the intervention of operators in its operation.

BACKGROUND OF THE INVENTION

Among the stages of the mineral exploration process is included the drilling or probing stage that aims to make holes or wells that allow characterizing the subsoil through obtaining samples in a study area. Drilling provides information on mineralization, verify grades, and determine mineral resources within the deposit, which makes it possible to evaluate and determine if the study area is economically exploitable.

The most widely used drilling systems are diamond drilling and reverse air drilling:

- Diamond drilling: Uses a diamond core bit to drill through rock, where the bit rotates at one end of a drill rod from a drilling machine. The core bit has an opening at its end that allows a solid core to be cut from the drilled rock that travels up a drill pipe that is located inside the drill rod and is recovered at the surface.
- Reverse air drilling: uses double-walled drill rods that define a center tube and outer tube, where once the ground is drilled compressed air is injected into the outer tube that destroys the rock and the air returns through the center tube of the bars dragging rock fragments, in the form of small chips, which are recovered on the surface.

In the case of diamond drilling, one of the most widely used forms of drilling is rotary drilling. The components that comprise a drilling rig are:

- Work platform: base of the drilling equipment, allows to resist the drilling carried out by the equipment and absorbs vibrations. It must be robust and firm enough to give stability to the drilling equipment.
- Elevation system: includes the equipment that allows holes or wells to be made, the tools that allow the equipment to be moved into or out of said well to extract the cores and recover them on the surface. The main components are:
  - Drilling rig: elongated steel structure for removing and inserting equipment from the hole or well. The drilling tools that allow drilling the rock and extracting cores are located in the tower.
  - Winch: component where the drag cable used to raise the drilling rods and their couplings is wound.
- Drive system: located in the drilling tower, it is in charge of producing the necessary energy for the rotation of the drilling string. The drive system comprises:

- Transmission: allows to vary the rotation speed and torque of the drilling equipment according to the conditions of the rock in depth.
  - Rotation Head—Used to add and remove drill rods from the drill string. The rotary head is directly connected to the drill string and is responsible for transmitting torque to the string.
  - Power unit: provides the necessary power to the rotating head, commonly correspond to gasoline or diesel engines.
- Drill string: set that includes the components that perforate the rock. This set is responsible for transmitting the torque from the rotation head to the crown bit that perforates the rock and allows the circulation of drilling fluid that lubricates and regulates the temperature of the crown bit. The drill string comprises:
  - Drilling rods: steel tubes with a diameter and length defined by the characteristics of the drilling equipment. They are in charge of transferring the torque and rotation from the equipment to the crown, in addition, serving as a distribution line for the refrigeration fluid.
  - Casing or casing rods: steel tube with a larger diameter than the drill rods, which functions as an artificial wall between the drill rod and the drilled rock. It allows avoiding collapse by stabilizing the drilled ground, preventing the entrapment of the drilling string.
  - Drilling tube: tube installed inside a drilling rod that allows to store the core that the diamond bit cuts from the rock. The drilling tube has a closing mechanism or davit that is connected to a threaded end of the tube, where said davit is connected to a cable that is used to hoist the drilling tube towards the drilling rig to later recover the core. From the tower.
  - Core drill bit: Located at the front or bottom end of the drill string, the bit is used to cut through rock and extract solid core from the drilled rock through an annular section so that the core is advanced during drilling. drilling and inserted into the drill pipe.
- Pumping system: continuous fluid feed system used to cool and lubricate crown bit tips, rods and all necessary components that have a high percentage of temperature rise during drilling, plus the fluid cleans debris from the ground lodged at the bottom of the well transporting them to the surface. The coolant fluid is typically water or mud with additives to extend the life of drillstring components. The pumping system includes:
  - Mud Pump: Allows the circulation of water or mud in the drill string from the fluid source to the bottom of the drilled hole so that the flow is as constant as possible.
  - Injection head: device comprising a fixed section and a rotating section, where hoses are connected to the fixed section that receive the fluid from the mud pump and inject it into the drilling rods, making it circulate to the bottom of the well. The device is coupled with the upper end of the drill rods by means of a patero in the swivel section of the device that allows the rotation of the drill string preventing the rotational movement of the hoses.

The components described above are large and heavy, which in the systems currently used must commonly be handled manually by site operators or the operators partially participate in the handling processes supporting the action of devices. or systems that transport said components, being said risky operations being carried out slowly because the operators must take the pertinent safeguards to avoid accidents.

In particular, the handling of drilling rods or tubes presents various complexities when large volume and mass suspended loads are generated, which are an important cause of accidents at work.

In addition, on site, it will be necessary to handle drilling rods or tubes of different sizes or lengths depending on the particular needs of a drilling process or the availability of items on site. In this sense, it is important that a handling device be adaptable, allowing for the efficient handling of drill rods or tubes with different characteristics, without the need to use multiple devices or that their parts must be modified or replaced depending on the length of their operation. the drill rod.

PRIOR ART

In the state of the art, solutions have been developed that include the use of devices that allow the manipulation of drill rods, the manipulation of drill rods from a rod platform to the drilling rig and vice versa, in addition to the coupling between rods.

In this regard, the document CL0375-2014 can be mentioned, which describes a drilling and probing system, a manipulator arm and a method for diamond drilling or wire line that comprises at least one rig, at least one rotation head and at least one press. bars, where said tower supports a column of bars through the rotation head and presses bars at a defined angle, where the drilling system further comprises: a bar lifting system, comprising a bar lifting system command, a platform work areas, platform perimeter railings, access stairs, an inner tube tray and a sample tray, and an assistant command; a bar manipulator arm; and an arm bar head.

Another document is U.S. Pat. No. 6,634,443B1, which discloses a drill rod handling device adapted to be fixed to the frame of a drilling rig, comprising: elongated guide means extending longitudinally on one side of the drilling rig frame; mounting means for attaching said guide means to said frame; a guided carriage assembly for sliding movement longitudinally along said guide means; drive means for carrying out said sliding movement of the carriage assembly; a laterally projecting swing arm pivotally mounted on the carriage to rotate in an axis parallel to the longitudinal axis of the frame; a grip assembly pivotally connected to the free end of the rocker arm, comprising an elongated support arm and a pair of opposed grip assemblies arranged to secure a drill rod during transportation. The support arm includes guide assemblies for the drilling rod at its ends. The grip assembly may include rollers to support and rotate the drill rod to make or break it.

A third relevant document is the application WO 2020/154804 A1 that discloses a manipulator apparatus for bars, outer tubes, and inner tubes, which comprises an adapter manipulator element to be aligned with an elongated bar, which includes a set of alignment jaws on a first end of the manipulator element that supports an inner tube and/or an outer tube in coaxial alignment with the elongated bar; a set of high speed jaws at a second end of the manipulator adapted to support at least one inner tube and operable to cause translation of said inner tube into or out of the elongate bar; and a low speed jaw assembly, located between the alignment jaw assembly and the high speed jaw assembly, adapted to support an outer tube and operable to generate translation and rotation of the outer tube to screw the elongated bar. The low speed jaw assembly has two drive rollers and two driven rollers, the assembly being mounted in a frame on the manipulator element for translation with respect to said frame to impart simultaneous translation and rotation to the outer tube. In this document, the movement of one of the jaw assemblies is aimed at allowing it to perform two actions on an outer tube simultaneously and does not allow modifying the handling capacity of bars or tubes.

Finally, the closest prior art document corresponds to application CL 2516-2020, on behalf of the applicant, which discloses a handling device (1) associated with a drilling rig (2) to handle and transport drilling rods when it is required to extend or decrease the reach of the drilling string of the drilling rig (2), in an automated way reducing the risks in the operation, comprising: a support (4) comprising: —upper and lower guides (5, 6) that are mounted on the support structure (4); a sliding carriage (7) comprising: —upper (8) and lower (9) sliding supports; —upper and lower guides (10, 11); —a carriage actuator (20); —a carriage arm actuator (15); —adjustable stroke limiters (28); where the sliding carriage (7) slides horizontally on the support (4) by means of the carriage actuator (20) in the upper (5) and lower (6) guides on which the carriage (7) rests in a sliding manner by the upper (8) and lower (9) sliding supports in which the adjustable stroke limiters (28) limit the stroke of the carriage (7); an arm (13) that slides horizontally on the sliding carriage (7) through the action of the carriage arm actuator (15), where the arm (13) is made up of: —an arm support (16) made up of a parallel right (26) and left (27) vertical plate, on which is the arm (13) joined by an articulated joint; —An arm actuator (12) that joins the arm support (16) with the arm (13) and that controls the movement between both; —an upper (29) and lower (30) sliding support located in the arm support structure (16), so that the arm support (16) slides on the upper (10) and lower (11) guides of the sliding carriage (7); —at least two gripping means (34, 35) in the arm structure (13) and separated from each other to support the drilling rods, so that when the arm is in a horizontal position, said gripping means (34, 35) 35) remain in a position facing the ground surface; method for using a handling device (1) associated with a drilling rig (2). A disadvantage of this solution is that the gripping means (34, 35) in the arm structure (13) are in a fixed position, so that the separation distance between them is constant, thus handling the bars Drilling of certain lengths or sizes will be made difficult depending on the dimensions of said arm (13) and the arrangement of the gripping means (34, 35).

The above documents disclose drill rod or pipe handling devices that the movement of said device follows a direction parallel to the longitudinal axis of a drilling rig which is not taught and/or suggests that a manipulator arm can move in one direction. perpendicular to the longitudinal axis of the derrick allowing the arm to travel between the derrick and a side in a horizontal direction perpendicular to the longitudinal axis of the derrick and, simultaneously, including at least one clamp or gripping means arranged in such a way that it can move or translate along the manipulator arm, varying the separation distance between the gripping means of the device.

SUMMARY OF THE INVENTION

The invention discloses a handling device associated with a drilling rig to manipulate drilling rods or tubes between a vertical position and a horizontal position in an automated manner that reduces risks in the operation, which is basically made up of a support, a carriage, and an arm with an arm support and at least two gripping means on the arm, separated from each other, for holding, capturing or gripping the drill rods, wherein at least one of said gripping means is movable in such a way that can move or move along the length of the arm, allowing the separation distance between the arm gripping means to be varied, facilitating the handling of different length perforation rods or pipes. The handling device allows the reach of the drill string to be extended or decreased from the derrick by transporting rods towards the derrick, adding them to the drill string, or transporting rods from the derrick, removing them from the drill string to deposit them in a storage place for said bars.

The carriage allows horizontal movement in the support on two cylindrical guides and, in turn, the arm and its support slide with respect to the carriage also horizontally on two other cylindrical guides, thus forming a mechanism that allows controlled horizontal movement. The movements of the carriage, the arm and its support are made by means of actuators. The arm and its support are joined by means of an articulated joint, which allows handling of the drilling rods or tubes from a position parallel to the longitudinal axis of the drilling rig and from a horizontal position, and vice versa. The arm operates automatically or is activated and/or controlled remotely from an external control panel or console.

The handling device for handling drill rods or pipes can be adapted to any working angle of the drill string, preferably between −90° to −45°.

DETAILED DESCRIPTION OF THE INVENTION

The invention refers to a handling device that facilitates the handling of different-sized drill rods or tubes, also reducing the risks in handling a tube from the drilling line and depositing it horizontally in an automated manner in a storage place for said tubes and vice versa.

Figure 1:
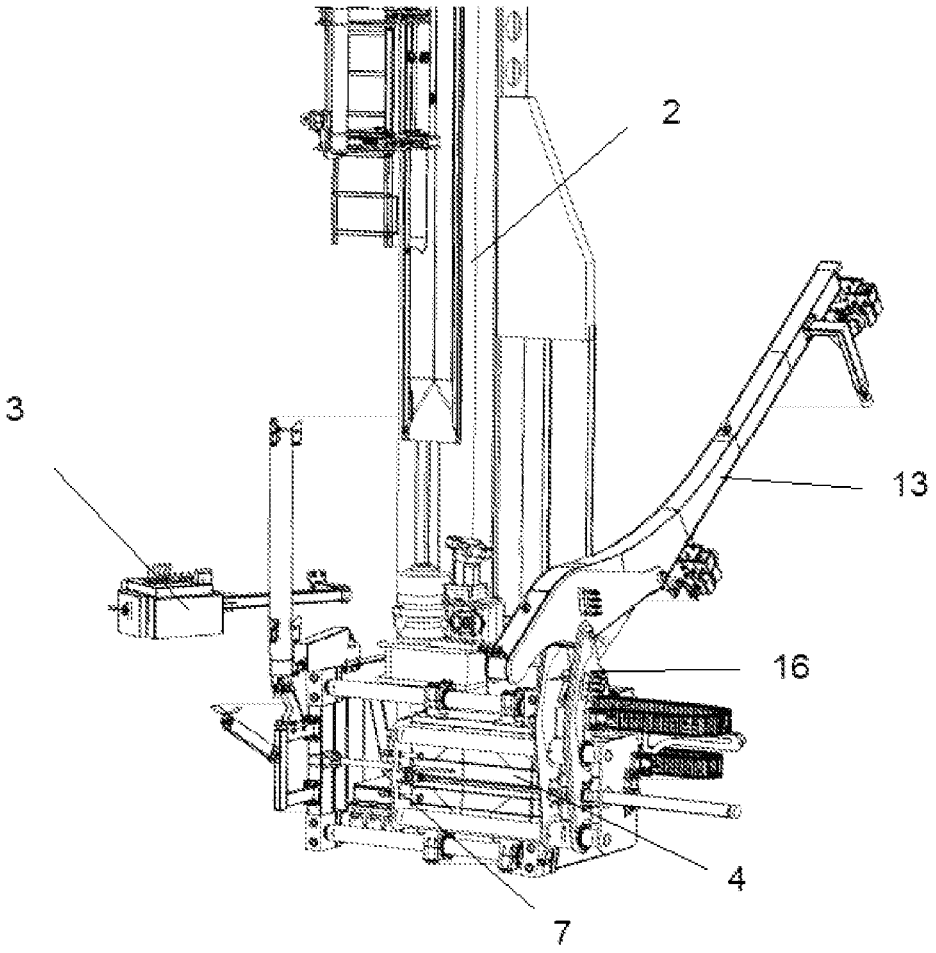
FIG. 1 PRIOR ART
FIG. 1 shows an isometric view of the handling device installed in a drilling rig described in the prior art.

FIG. 1 shows the handling device (1) according to the prior art, which is used as the basis for the present invention. Said handling device (1) is installed in a drilling rig (2), in that the device (1) is controlled from a control console (3) and is basically made up of a support (4) installed in the front part of the base or lower area of the drilling tower (2) and a manipulator arm (13) with an arm support (16) connected to said support (4).

Figure 2:
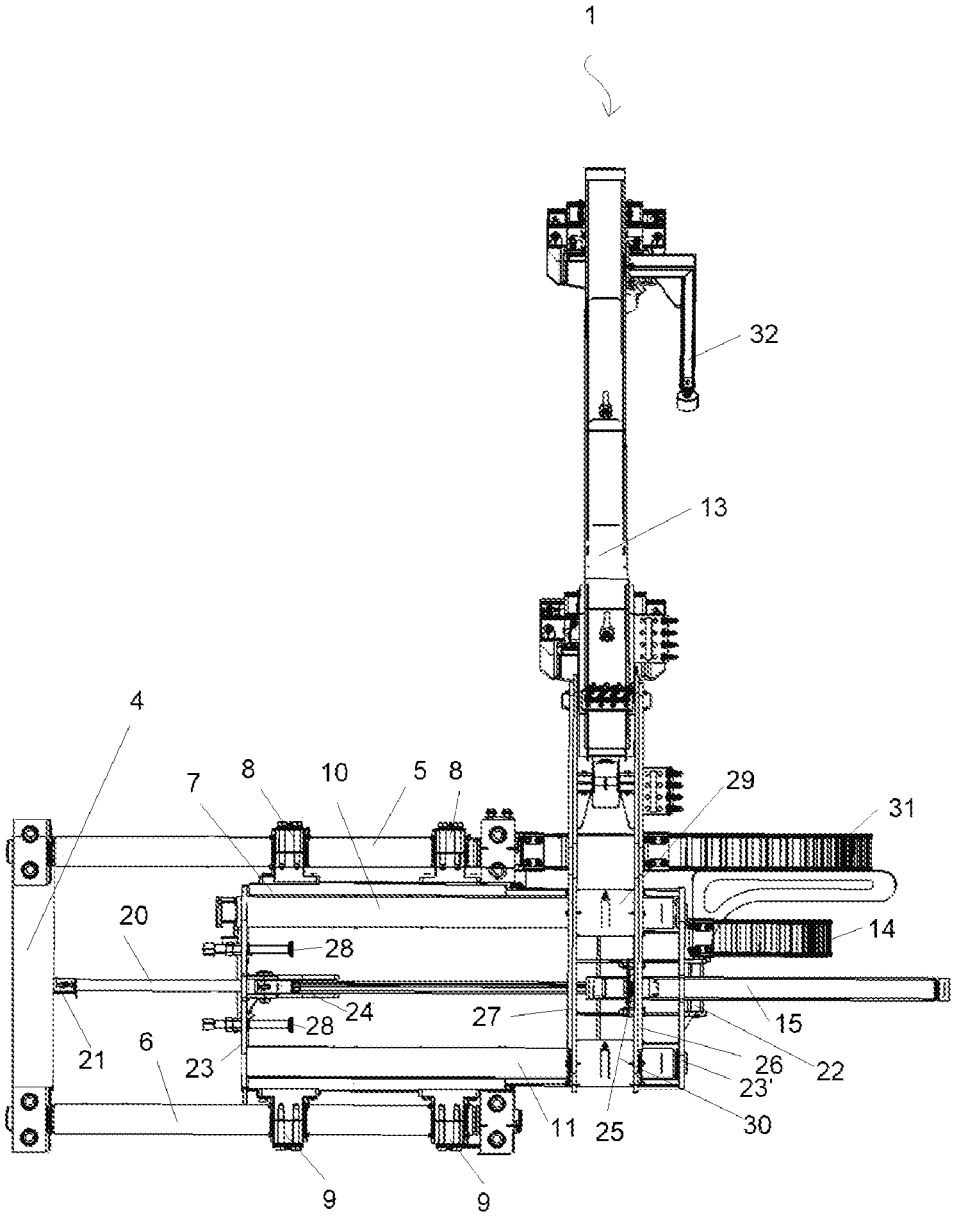
FIG. 2 PRIOR ART
FIG. 2 shows a front view of the handling device described in the prior art.

In the front view shown in FIG. 2, it can be seen that the support (4) comprises an upper guide (5) of the support (4) and a lower guide (6) of the support (4) fixedly mounted and in the opposite direction. horizontal; a sliding carriage (7) mounted on the upper guide (5) and the lower guide (6) of the support (4) by means of a sliding joint that allows its movement in a horizontal direction on said guides (5, 6) and parallel to the floor with respect to the support (4).

The connection between the sliding carriage (7) and the upper guide (5) and lower guide (6) of the support (4) is produced by means of two sliding supports (8) mounted on the upper part of the sliding carriage (7) and two sliding supports (9) mounted at the bottom of the sliding carriage (7), wherein said sliding supports (8, 9) are arranged between a left wall (23) and a right wall (23') of the sliding carriage structure (7). The sliding carriage (7) comprises a cable-carrying chain (14), which comprises two opposite ends, being fixed at one end to the right wall (23') of the sliding carriage (7) and at the opposite end it is fixed to a wall of the support (4) in such a way that it restricts the maximum horizontal displacement or stroke that the sliding carriage (7) can move. The horizontal sliding movement of the sliding carriage (7) is carried out by means of a carriage actuator (20) joined at one of its ends to the support structure (4), by means of an articulated joint (21) and, at the other end, to the right wall (23') of the sliding carriage structure (7) by means of a fixed joint (22). The sliding carriage (7) further comprises an upper guide (10) and a lower guide (11) arranged between the left wall (23) and the right wall (23') of the sliding carriage (7).

On the upper guide (10) and the lower guide (11) of the sliding carriage (17) the arm support (16) is mounted by means of a sliding joint that allows movement in a horizontal direction parallel to the floor on the sliding carriage (7), and through an upper sliding support (29) and a lower sliding support (30) located in the arm support structure (16), where said sliding supports (29, 30) are arranged between a right vertical plate (26) and a left vertical plate (27) of the arm support (16), being parallel to each other.

In one embodiment, the support guides (5, 6), carriage guides (10, 11) and sliding support (8, 9) of the sliding carriage (7) are cylindrical.

Figure 3:
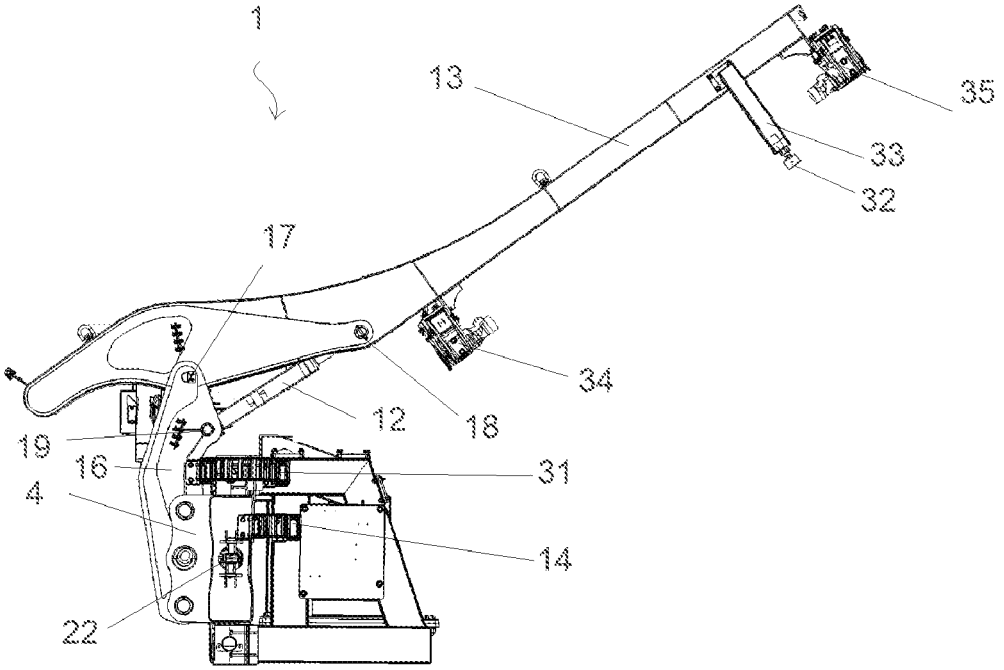
FIG. 3 PRIOR ART
FIG. 3 shows a side view of the handling device described in the prior art.
Figure 4:
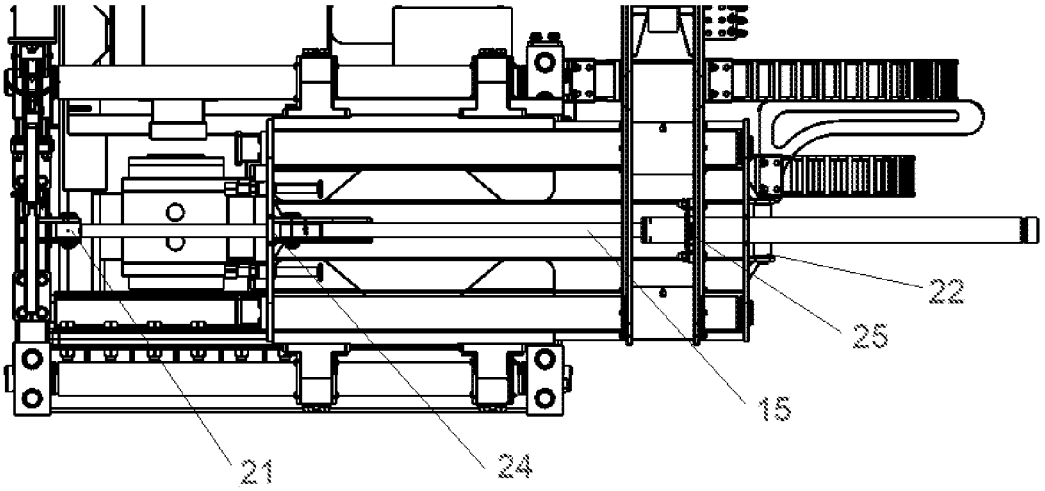
FIG. 4 PRIOR ART
FIG. 4 shows the elements associated with the horizontal movement of the arm of the handling device.
Figure 5:
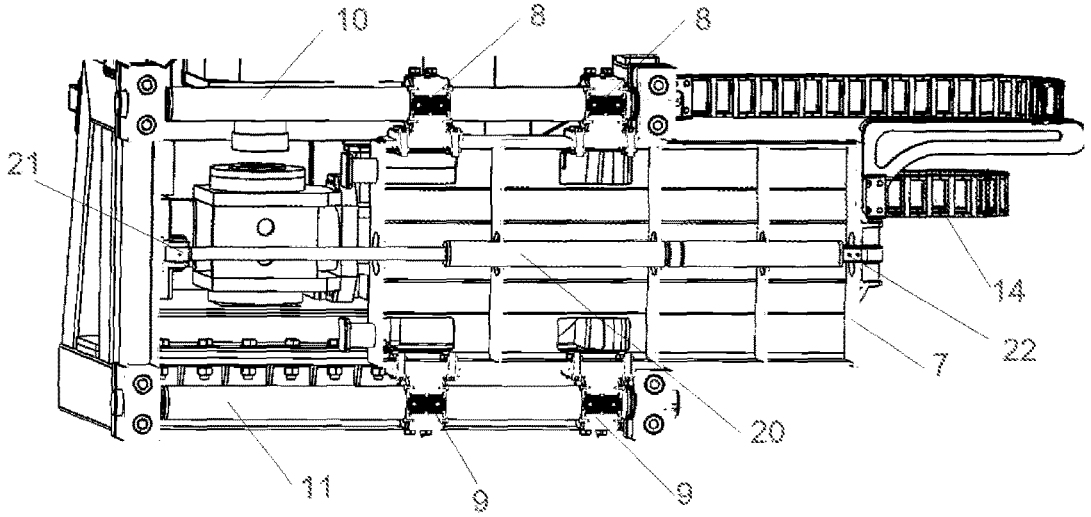
FIG. 5 PRIOR ART
FIG. 5 shows the elements associated with the horizontal displacement of the carriage described in the prior art.

As shown in FIG. 3, the arm support (16) is attached, in turn, to an elongated manipulator arm (13), whose connection is made by means of a pin (17) that generates an articulated connection and allows movement. articulated between the manipulator arm (13) and the arm support (16). The movement of the manipulator arm (13) is carried out by means of an arm actuator (12) joined at one of its ends to the arm support (16) and, at the other end, to said manipulator arm (13), so that its Drive produces the rotation of the manipulator arm (13) allowing its rotation between a horizontal position and a vertical position. The union of the manipulator arm (13) with the arm actuator (12) is carried out by means of a first pin (18) and the union of the arm support (16) with the arm actuator (12) is carried out with a second pin (19).

To produce the horizontal movement of the manipulator arm (13), with respect to the sliding carriage (7), a carriage arm actuator (15) is used, which is attached by one of its ends to the left wall (23) of the sliding carriage (7).), by means of an articulated joint (24) and, at the other end, it is connected, by means of a fixed joint (25), to the right vertical plate (26) of the arm support (16). The horizontal movement of the arm support (16) on the sliding carriage (7) is regulated by two adjustable limiters (28) located on the left wall (23) of the sliding carriage (7). The arm support (16) also includes a cable chain (31), which includes two opposite ends, a first end being fixed to the right vertical plate (26) of the arm support (16) and a second fixed end. to the support (4), restricting the maximum horizontal displacement that the arm support (16) and the manipulator arm (13) can move.

The manipulator arm (13) comprises at least two capture or gripping means (34, 35) of the drilling rods, installed in the structure of the manipulator arm (13) and separated from each other, so that when the manipulator arm (13)) is in a horizontal position, said gripping means (34, 35) remain in a position facing the ground surface; and an adjustable stop (32) attached to the structure of the manipulator arm (13) by means of a square (33) located in an area close to the end of the manipulator arm (13), to regulate or ensure the alignment of the bar with the head when the manipulator arm (13) will position the rod in the drill string.

The handling device (1) is connected to a control console (3), which is located at a safe distance from the drilling rig (2) so that an operator controls and actuates the handling device (1) without intervening directly on it. The handling device (1) is connected to the control console (3) through a wired system or through a wireless connection. The control console (3) allows to activate and control the arm actuator (12), the carriage arm actuator (15), the carriage actuator (20) and the gripping means (34, 35).

Figure 6:
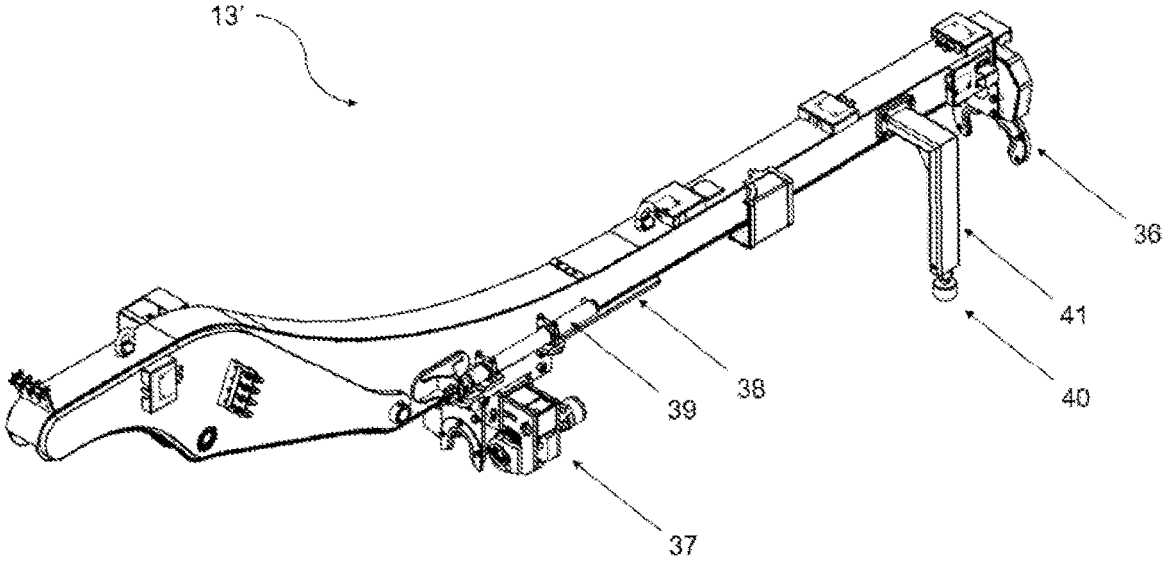
FIG. 6 shows an arm for the handling device according to one embodiment of the invention.

In this invention, a manipulation device is provided that corresponds to a modification of the manipulation device (1), providing a new manipulator arm (13'), as shown in FIG. 6, which is attached to the support of arm (16) whose connection is made by means of the pin (17) that generates an articulated connection and allows articulated movement between the manipulator arm (13') and the arm support (16). The movement of the manipulator arm (13') is carried out by means of the arm actuator (12), joined at one of its ends to the arm support (16) and, at the other end, to said manipulator arm (13'), in such a way that so that its activation produces the rotation of the manipulator arm (13') allowing its rotation between a horizontal position and a vertical position. The union of the manipulator arm (13') with the arm actuator (12) is made by means of the first pin (18)

Figure 7:
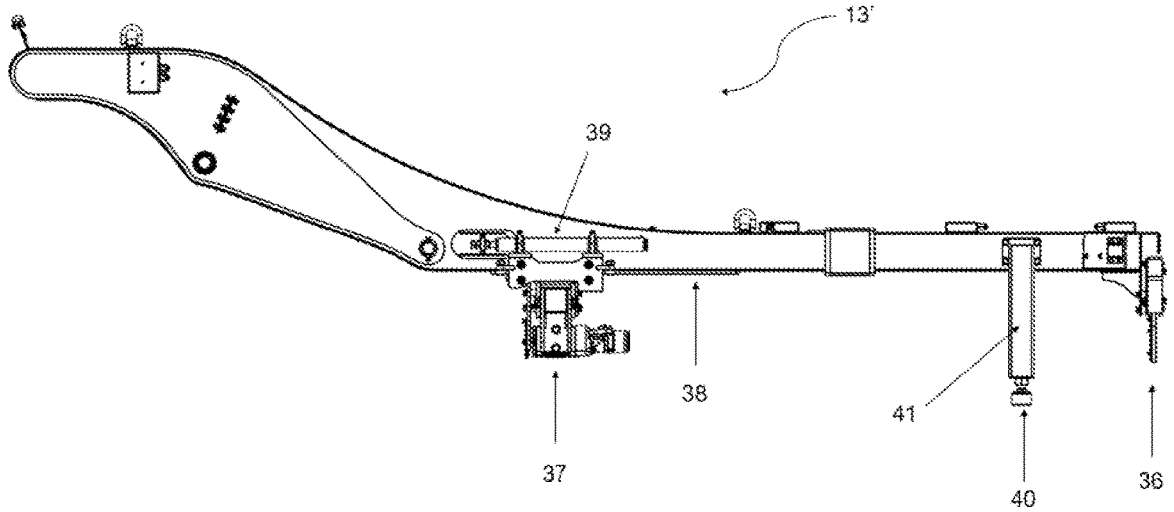
FIG. 7 shows the arm for the handling device according to one embodiment of the invention when in a horizontal position.

The manipulator arm (13') comprises means for capturing or gripping drilling rods, which include at least one clamp or gripper (36) and at least one press (37) installed in the structure of the manipulator arm (13') and separated from each other, so that when the manipulator arm (13') is in a horizontal position, said gripper (36) and press (37) remain in a position facing the ground surface, position shown in FIG. 7 The manipulator arm (13') also includes an adjustable stop (40) attached to the arm structure (13') by means of a square (41), to regulate or ensure the alignment of the bar with the head when the arm manipulator (13') is going to position the rod in the drill string.

Figure 8:
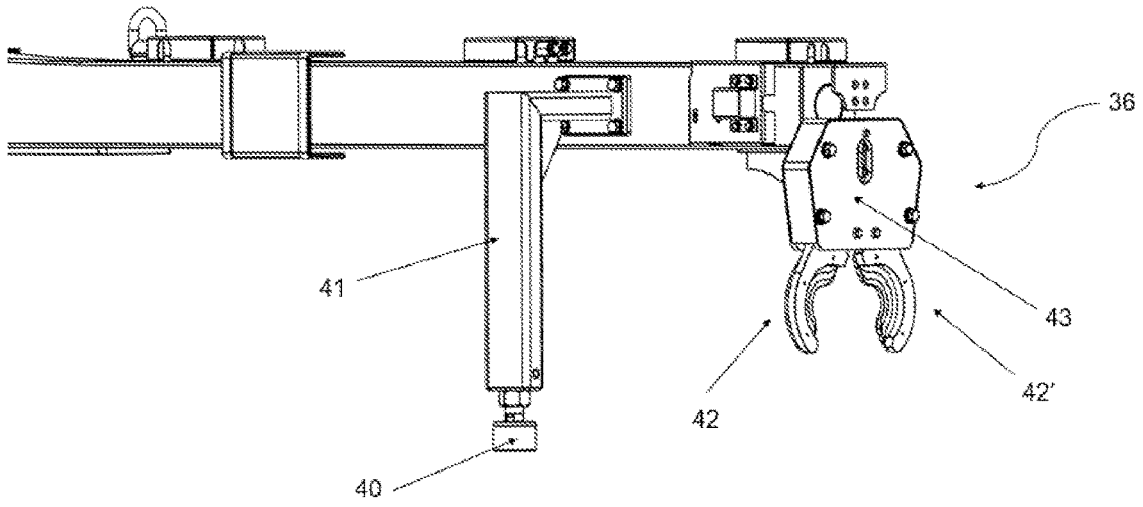
FIG. 8 shows a gripper installed on the arm for the handling device according to one embodiment of the invention.
Figure 9:
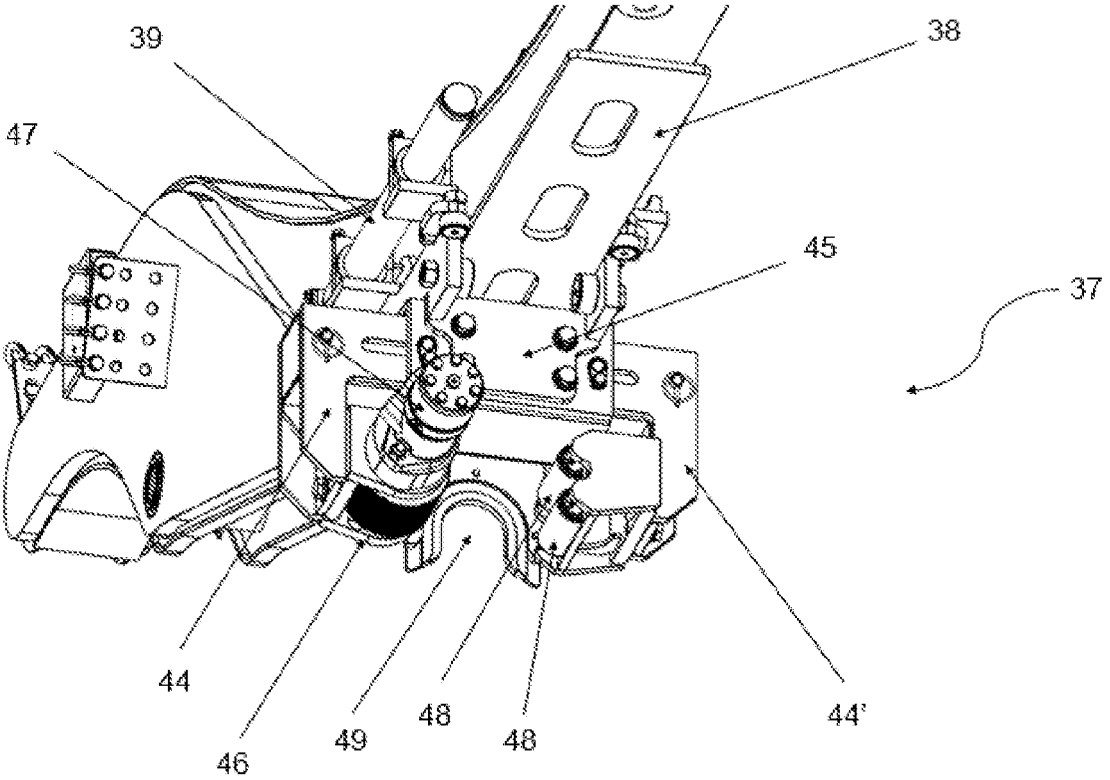
FIG. 9 shows a clamp installed on the arm for the handling device according to one embodiment of the invention.

In one embodiment, as shown in FIG. 8, the gripper (36) is installed at the outer end of the manipulator arm (13'), which corresponds to the end of the manipulator arm (13') that is furthest from the support of arm (16), the gripper (36) being made up of a first clamp (42) and a second clamp (42') articulatedly connected at their ends in a clamp junction box (43). For its part, the press (37) is arranged around the middle area of the manipulator arm (13'), in a location close to the junction area of the manipulator arm (13') and the arm actuator (12), as shown in FIGS. 6 and 7. As can be seen in FIG. 9, the press (37) is made up of a first jaw (44) and a second jaw (44') connected in an articulated manner at their ends in a jaw junction box (45), wherein the first jaw (44) comprises a driving roller (46) commanded by a motor (47), and the second jaw (44') comprises at least two more driven rollers (48). smaller than the driving roller (46), where, in addition, the rear part of the press (37) comprises a platen (49) with a recess to support a perforation bar during the operation of the handling device. In one embodiment, the sinker knockout (49) has a semicircular shape that allows the drill rod to fit properly. The plate (49) is a guide, slightly larger in diameter than the drill rod, being an interchangeable element. The motor (47) of the driving roller (46) allows driving said roller (46) generating a rotary movement that allows unscrewing a perforation rod held in the press (37). The driving roller (46) and the driven rollers (48) are arranged parallel to each other, allowing the handling of drill rods of different lengths. The opening and closing of the gripper (36) and the vise (37) is controlled by actuators inside the junction box for grippers (43) and inside the junction box for jaws (45), respectively.

The press (37) is mounted on a frame (38) in the structure of the manipulator arm (13') that allows its movement on said frame (38), moving along the arm (13') allowing to vary the distance of separation between the press (37) and the gripper (36) to facilitate the manipulation of perforation rods of different lengths.

In one embodiment, the frame (38) has a rectangular shape and is fixed to the structure of the manipulator arm (13') so that the long sides of the frame (38) are parallel to the longitudinal axis of the manipulator arm (13'), being fixed on the face of the manipulator arm (13') that faces the ground, floor or surface when the manipulator arm (13') is in a horizontal position, as shown in FIG. 9.

Figure 10A:
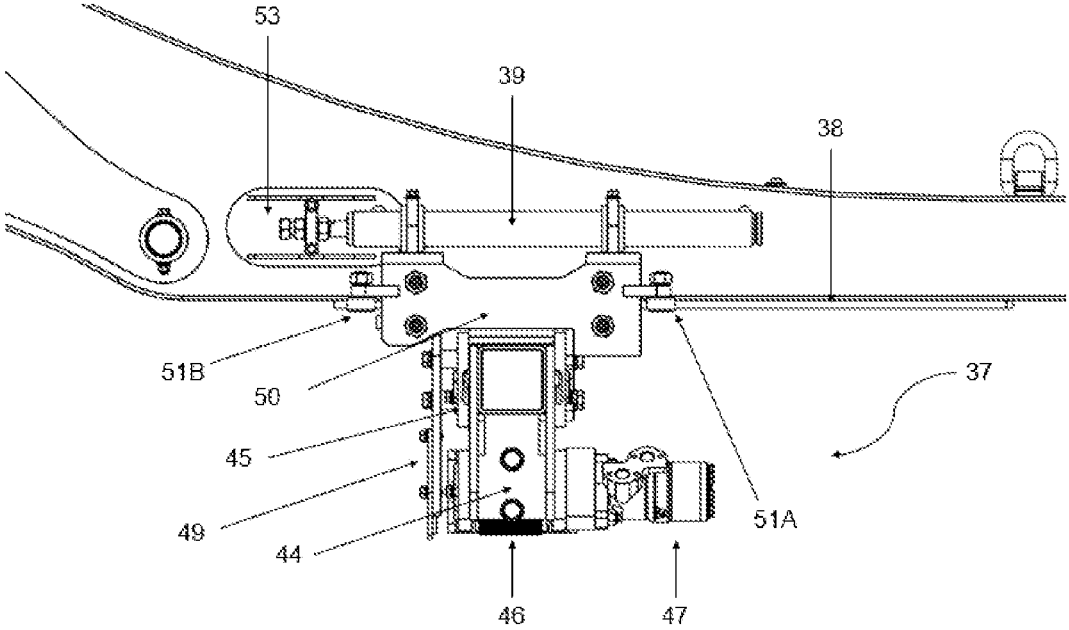
FIG. 10A shows a left side view of the clamp installed on the arm for the handling device according to one embodiment of the invention.
Figure 10B:
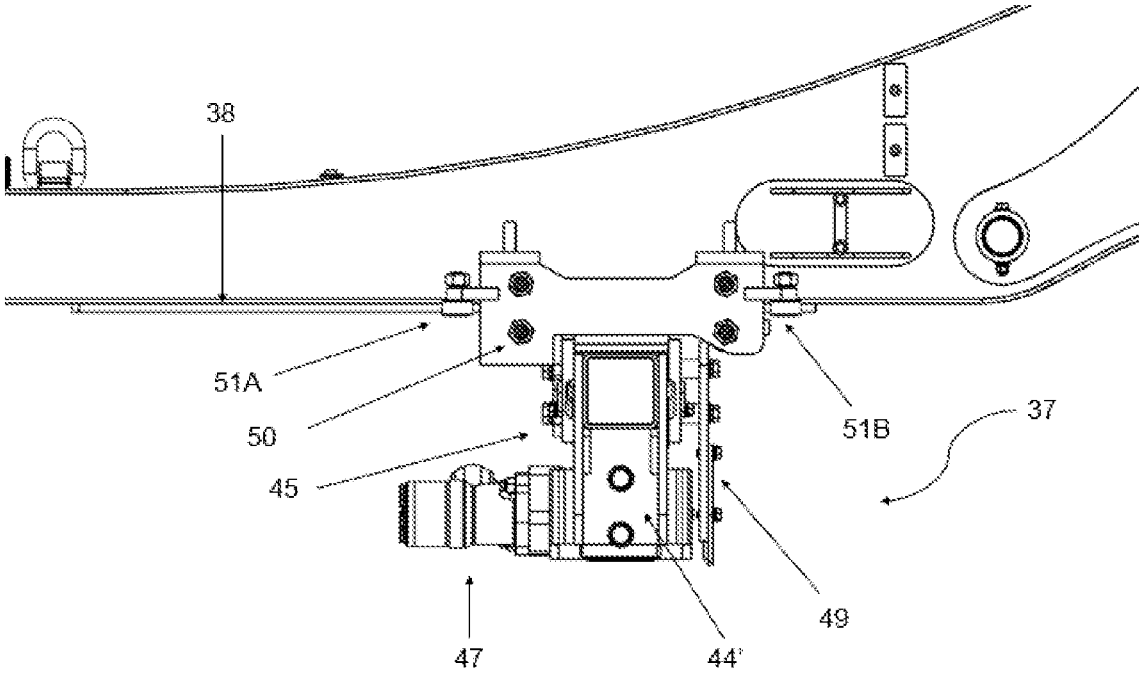
FIG. 10B shows a right side view of the clamp installed on the arm for the handling device according to one embodiment of the invention.
Figure 11:
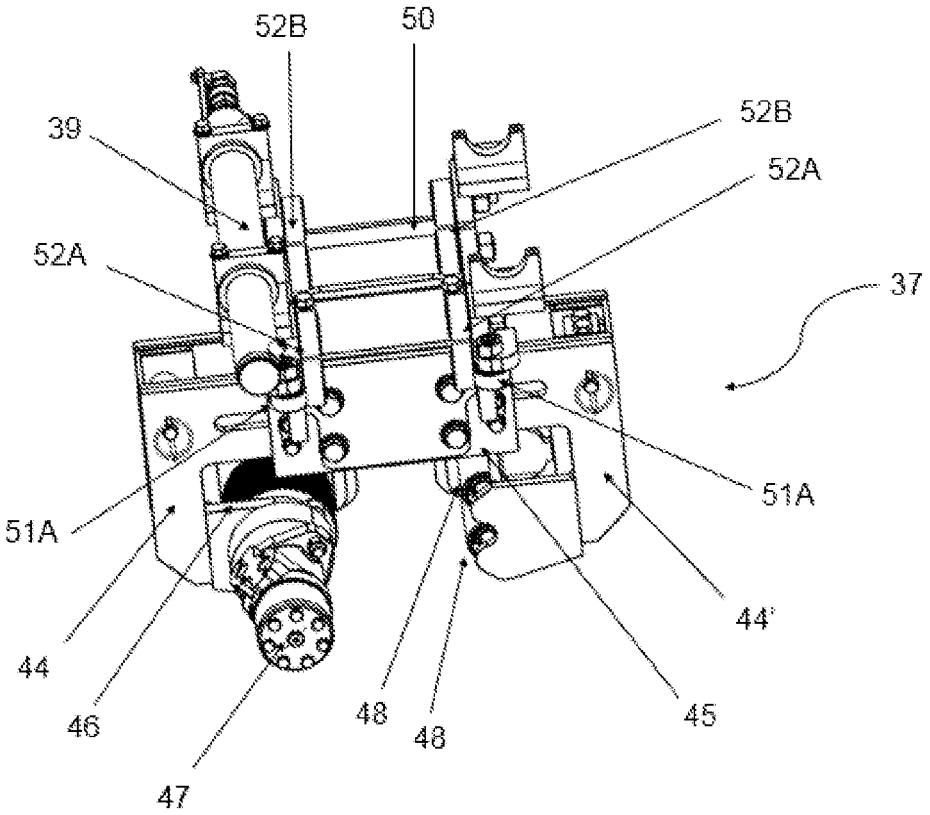
FIG. 11 shows the arm press according to one embodiment of the invention.

In one embodiment, the press (37) is mounted on the frame (38) by means of a movable support (50), which is linked to at least one advance actuator (39) to produce a sliding movement of the press (37) at along the frame (38) determining the stroke of the press (37). Said advance actuator (39) is located on a side face of the manipulator arm (13'), as shown in FIG. 10A, having one end attached to said side face of the manipulator arm (13'), by means of a fixed joint (53) and the mobile part of the advance actuator (39) is attached to the mobile support (50), generating the movement. As shown in FIG. 11, the mobile support (50) is mounted on the frame by means of a plurality of wheels that allow the sliding of the press (37) on the frame (38), these being at least one pair of lateral wheels front (51A) in the front part of the mobile support (50) to move, each one on a side face of the frame (38); at least one pair of rear side wheels (51B) at the rear of the mobile support (50) to move, each one on a side face of the frame (38); at least one front wheel assembly (52A) on each side of the front part of the mobile support (50), and on the first jaw (44) and the second jaw (44'), respectively, comprising an upper wheel and a lower wheel arranged one above the other and separated from each other so that the frame (38) is between said wheels; and at least one rear wheel assembly (52B) on each side of the rear part of the mobile support (50), and on the first jaw (44) and the second jaw (44'), respectively, comprising an upper wheel and a lower wheel arranged one above and separated from each other so that the frame (38) is between said wheels.

In one modality, the gripper (36) and the press (37) allow manipulating drilling rods between 3 and 6 meters long. In another embodiment, the vise (37) can handle 3 meter long drill rods by itself without the need to use the grip of the drill rod with the gripper (36). Optionally, the manipulator arm (13') It can include an additional press, for example, installed between the gripper (36) and the jaw (37), favoring the screwing or unscrewing of the drilling rod.

The handling device is connected to the control console (3), which is located at a safe distance from the drilling rig (2) so that an operator can control and activate the handling device without directly intervening on it. The handling device is connected to the control console (3) through a wired system or through a wireless connection. The control console (3) allows activating and controlling the arm actuator (12), the carriage arm actuator (15), the carriage actuator (20), the actuators inside the clamp junction box (43) and inside the jaw junction box (45), and the advance actuator (39) of the press (37).

Figure 12:
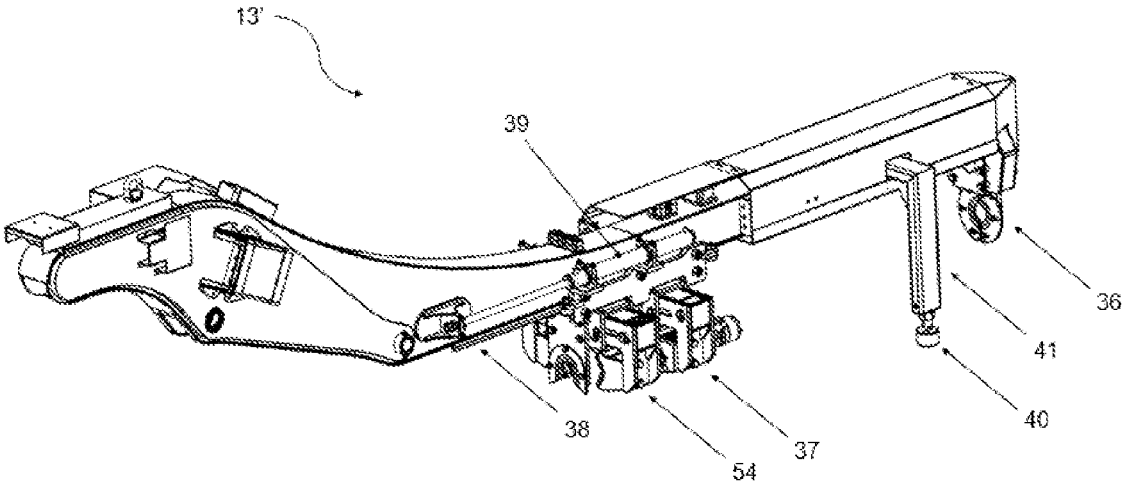
FIG. 12 shows an arm for the handling device according to an alternative embodiment of the invention.
Figure 13:
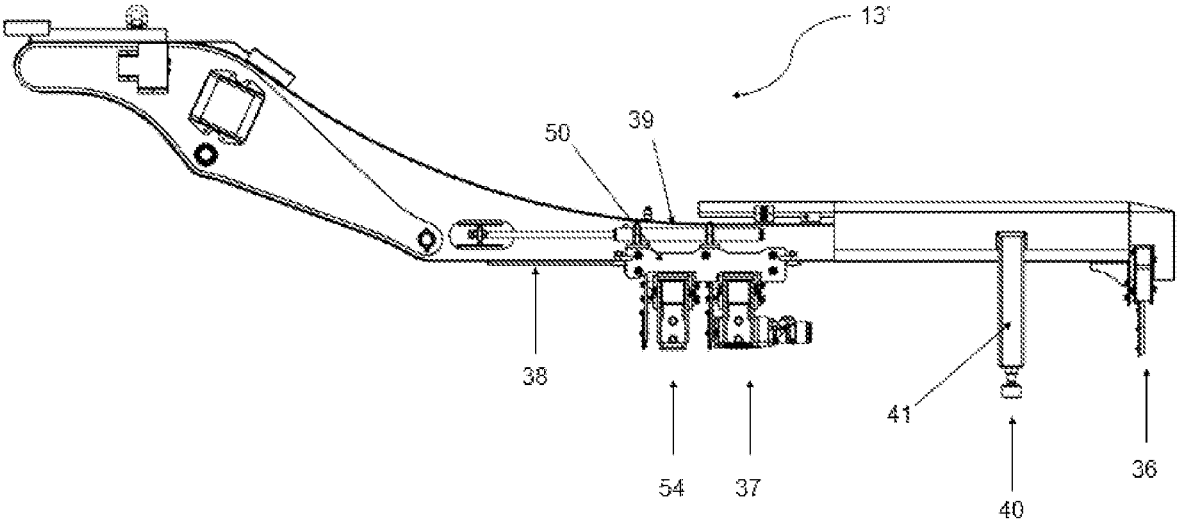
FIG. 13 shows the arm for the handling device according to an alternative embodiment of the invention when it is in a horizontal position.

In an alternative embodiment of the manipulator arm (13'), as shown in FIGS. 12 and 13, which further comprises a gripping press (54) mounted on the frame (38) in the structure of the manipulator arm (13') by means of the mobile support (50) together with the press (37) and adjacent to the rear part of the press (37). The gripping press (54) complements the grip of the press (37) favoring the screwing or unscrewing of the drilling rod.

Figure 14:
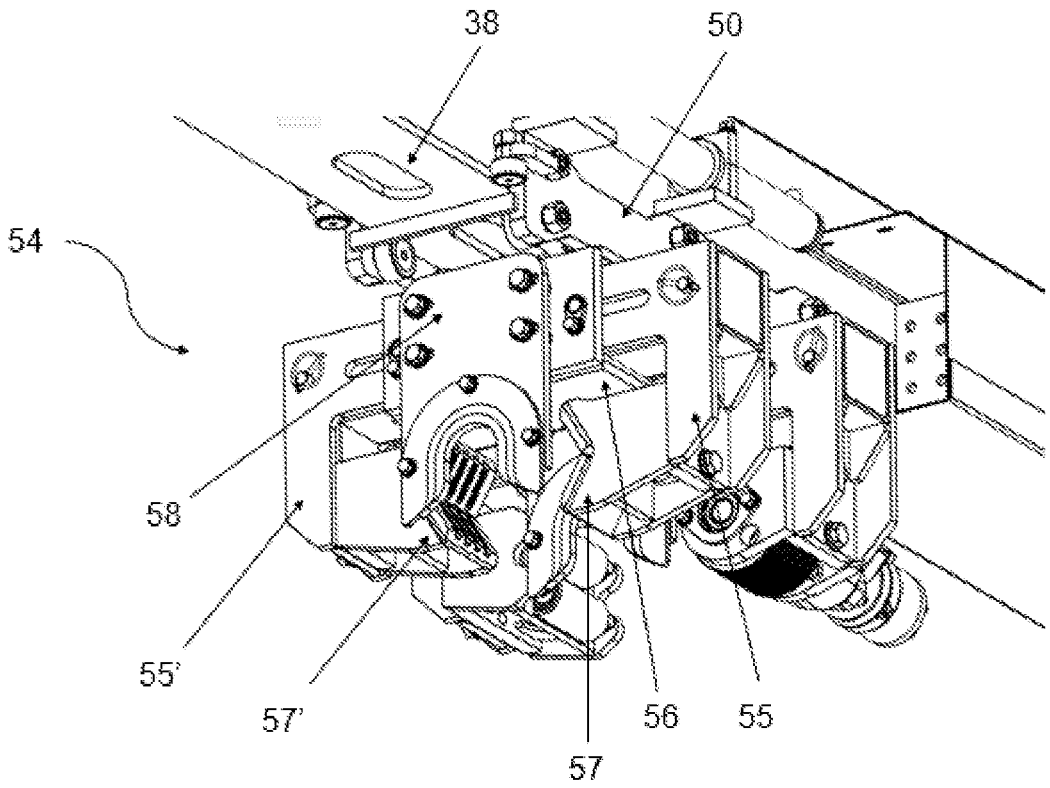
FIG. 14 shows the arm grip press according to an alternative embodiment of the invention.

As can be seen in FIG. 14, the gripping press (54) comprises a first jaw (55) and a second jaw (55') articulatedly connected at their ends in a jaw junction box (56), in wherein the first jaw (55) and the second jaw (55') comprise a first jaw (57) and a second jaw (57'), respectively for holding and securing the drill rod during operation of the handling device, wherein The rear part of the gripper (54) comprises a platen (58) with a recess for supporting a drill rod during operation of the handling device. In one embodiment, the sinker knockout (58) has a semicircular shape that allows the drill rod to fit properly. The plate (58) is a guide, slightly larger in diameter than the drill rod, being an interchangeable element. The opening and closing of the gripping press (54) is controlled by at least one actuator inside the jaw junction box (56).

In one modality, the principle of operation of the manipulator arm (13') for the manipulation device, when it includes a clamp (54), consists of screwing and unscrewing the drilling rods of a drilling string, for which it is used a hydraulic circuit that operates under the flotation principle according to the following sequence:

1. To remove a drill rod from the drill string:
   - Activate the closing function of the manipulator arm (13') to simultaneously close the press (37) and gripping press (54);
   - Activate a sequence control by pressure to activate the advance actuator (39), keeping the rod threaded in the drill string;
   - Activate the unscrewing function that produces, by means of a hydraulic sequence and hydraulic piloting, the opening of the gripping press (54) and activation of the motor (47) of the press (37) to unscrew the drilling rod;
   - Close the vise grip (54) and activate the feed actuator (39) to lift the rod up and out of the drill string.
2. To add a drill rod to the drill string:
   - When a drill rod is added, the vise (37) and clamp (54) are closed holding a drill rod and the frame (38) is at the top of its travel;
   - Place the function of the press (37) in neutral, so that the advance actuator (39) descends by its own weight;
   - When the press (37) is close to the drilling string, the screw-in function is activated, which produces, through a hydraulic sequence and hydraulic piloting, the opening of the gripping press (54) and activation of the motor (47) of the drill string. press (37) to thread the drill rod into the drill string.

The invention claimed is:

1. A handling device associated with a drilling rig to manipulate and transport drilling rods when it is required to extend or decrease the drilling reach of the rig's drill string, which decreases the risks in the operation and facilitates the handling of drill rods of different lengths, including:

- a support comprising an upper guide and a lower guide fixedly and horizontally mounted;
- a sliding carriage mounted on the upper guide and the lower guide by means of a sliding joint that allows its movement in the horizontal direction on said guides, comprising
  - a structure with a left wall and a right wall;
  - two sliding supports mounted on the upper part of the sliding carriage and two sliding supports mounted on the lower part of the sliding carriage, arranged between said left and right walls, where said sliding supports generate the sliding joint with the support;
  - an upper guide and a lower guide between the left wall and the right wall;
  - adjustable stroke limiters on the left wall that limit the horizontal stroke of the sliding carriage;
- an arm support mounted on the upper guide and the lower guide of the sliding carriage by means of a sliding joint that allows its movement in the horizontal direction on said sliding carriage, comprising:
  - a right vertical plate and a left vertical plate parallel to each other;
  - an upper sliding support and a lower sliding support located in the structure of the arm support, between its right and left vertical plates, generating the sliding joint with the sliding carriage;
  - a manipulator arm attached to the arm support by means of an articulated joint that allows articulated movement between said manipulator arm and the arm support;
  - a carriage actuator attached to the support and the sliding carriage, which generates the horizontal movement of said sliding carriage on the support;
  - a carriage arm actuator attached to the sliding carriage and the arm support that generates the horizontal movement of said arm support on the sliding carriage;
  - an arm actuator attached to the arm support and the manipulator arm that controls the articulated movement between both, generating the rotation of the manipulator arm allowing its rotation between a horizontal position and a vertical position, wherein the manipulator arm comprises at least one clamp or gripper and at least one press to hold the drilling rods, in the structure of the manipulator arm and separated from each other, wherein the press is mounted on a frame in the structure of the manipulator arm that allows its movement on said frame to move the press along the manipulator arm varying the separation distance between said press and gripper, wherein the frame has a rectangular shape and is fixed to the structure of the manipulator arm so that the larger sides of the frame are parallel to the longitudinal axis of the manipulator arm, being fixed on the face of the manipulator arm that faces the ground, floor or surface when the manipulator arm is in a position horizontal, and wherein the mobile support is mounted on the frame by means of a plurality of wheels that allow the sliding of the press on the frame;

wherein the plurality of wheels of the mobile support comprises at least one pair of front side wheels in the front part of the mobile support to move, each one on a side face of the frame; at least one pair of rear side wheels at the rear of the mobile support to move, each one on a side face of the frame; at least one front wheel assembly on each side of the front part of the mobile support and at least one rear wheel assembly on each side of the rear part of the mobile support; and wherein the front wheel assembly and the rear wheel assembly comprise, respectively, an upper wheel and a lower wheel arranged one on another and separated from each other so that the frame is between said wheels.

2. The handling device for handling and transporting drill rods according to claim 1, wherein the press is mounted on the frame by means of a mobile support, which is linked to at least one actuator advance to produce a sliding movement of the press along the frame, wherein said advance actuator determines the stroke of the press in the manipulator arm.

3. The handling device for handling and transporting drill rods according to claim 2, wherein the advance actuator is located on a side face of the manipulator arm, having one end attached to said side face of the manipulator arm, by means of a fixed joint and the moving part of the advance actuator is attached to the mobile support, generating the movement.

4. The handling device for handling and transporting drill rods according to claim 2, wherein the manipulator arm further comprises a gripping press mounted on the frame adjacent to the rear of the press, by means of the mobile support.

5. The handling device for handling and transporting drill rods according to claim 4, wherein the gripping press comprises a first jaw and a second jaw connected in an articulated manner at their ends in a jaw union box comprising an actuator that controls the opening and closing of the gripping press.

6. The handling device for handling and transporting drill rods according to claim 4, wherein the rear part of the movable support comprises a plate with a recess to support a drill rod during the operation of the handling device.

7. The handling device for handling and transporting drill rods according to claim 1, wherein the gripper is installed at the outer end of the manipulator arm, which corresponds to the end of the manipulator arm that is furthest from the arm support and the press is arranged around the middle area of the manipulator arm, in a location close to the area union of the manipulator arm and the arm actuator.

8. The handling device for handling and transporting drill rods according to claim 1, wherein the gripper comprises a first clamp and a second clamp connected in an articulated manner at their ends in a clamp junction box comprising an actuator that controls the opening and closing of the gripper.

9. A handling device associated with a drilling rig to manipulate and transport drilling rods when it is required to extend or decrease the drilling reach of the rig's drill string, which decreases the risks in the operation and facilitates the handling of drill rods of different lengths, including:

a support comprising an upper guide and a lower guide fixedly and horizontally mounted;

a sliding carriage mounted on the upper guide and the lower guide by means of a sliding joint that allows its movement in the horizontal direction on said guides, comprising a structure with a left wall and a right wall;

two sliding supports mounted on the upper part of the sliding carriage and two sliding supports mounted on the lower part of the sliding carriage, arranged between said left and right walls, where said sliding supports generate the sliding joint with the support;

an upper guide and a lower guide between the left wall and the right wall;

adjustable stroke limiters on the left wall that limit the horizontal stroke of the sliding carriage;

an arm support mounted on the upper guide and the lower guide of the sliding carriage by means of a sliding joint that allows its movement in the horizontal direction on said sliding carriage, comprising:

a right vertical plate and a left vertical plate parallel to each other;

an upper sliding support and a lower sliding support located in the structure of the arm support, between its right and left vertical plates, generating the sliding joint with the sliding carriage;

a manipulator arm attached to the arm support by means of an articulated joint that allows articulated movement between said manipulator arm and the arm support;

a carriage actuator attached to the support and the sliding carriage, which generates the horizontal movement of said sliding carriage on the support;

a carriage arm actuator attached to the sliding carriage and the arm support that generates the horizontal movement of said arm support on the sliding carriage;

an arm actuator attached to the arm support and the manipulator arm that controls the articulated movement between both, generating the rotation of the manipulator arm allowing its rotation between a horizontal position and a vertical position, wherein the manipulator arm comprises at least one clamp or gripper and at least one press to hold the drilling rods, in the structure of the manipulator arm and separated from each other, wherein the press is mounted on a frame in the structure of the manipulator arm that allows its movement on said frame to move the press along the manipulator arm varying the separation distance between said press and gripper wherein the press comprises a first jaw and a second jaw connected in an articulated manner at their ends in a jaw union box comprising an actuator that controls the opening and closing of the press and wherein the first jaw comprises a driving roller commanded by a motor, and the second jaw comprises at least two driven rollers smaller than the driving roller, where the motor of the driving roller drives said roller generating a rotary movement that allows unscrewing a drill rod held in the press.

10. A manipulator arm for a handling device to manipulate and transport drilling rods, which reduces the risks in the operation and facilitates the handling of drilling rods of different lengths, wherein it comprises at least one clamp or gripper and at least one press to hold the perforation bars, in the manipulator arm structure and separated from each other, wherein the press is mounted on a frame in the structure of the manipulator arm that allows its movement on said frame to move the press along the manipulator arm varying the separation distance between said press and gripper;

wherein the press comprises a first jaw and a second jaw connected in an articulated manner at their ends in a jaw union box comprising an actuator that controls the opening and closing of the press, and wherein the first jaw comprises a driving roller commanded by a motor, and the second jaw it comprises at least two driven rollers smaller than the drive roller where the motor of the driving roller drives said roller generating a rotary movement that allows unscrewing a drill rod held in place.

11. The manipulator arm for a handling device according to claim 10, wherein the press is mounted on the frame by means of a movable support, which is linked to at least one actuator advance actuator to produce a sliding movement of the press along the frame, wherein said advance actuator determines the stroke of the press in the manipulator arm.

12. The manipulator arm for a handling device according to claim 11, wherein the advance actuator is located on a side face of the manipulator arm, having one end attached to said side face of the manipulator arm, by means of a fixed joint and the moving part of the advance actuator is attached to the mobile support, generating the movement.

13. The handling device for handling and transporting drill rods according to claim 11, wherein the manipulator arm further comprises a gripping press mounted on the frame adjacent to the rear of the press, by means of the mobile support.

14. The manipulator arm for a handling device according to claim 10, wherein the frame has a rectangular shape and is fixed to the structure of the manipulator arm so that the larger sides of the frame are parallel to the longitudinal axis of the manipulator arm, being fixed on the face of the manipulator arm that faces the ground, floor or surface when the manipulator arm is in a horizontal position, wherein the mobile support is mounted on the frame by means of a plurality of wheels that allow the sliding of the press on the frame.

15. The manipulator arm for a handling device according to claim 10, wherein the gripper comprises a first clamp and a second clamp connected in an articulated manner at their ends in a clamp junction box comprising an actuator that controls the opening and closing of the gripper.

* * * * *